US006131522A

United States Patent [19]

Chavez

[11] Patent Number: 6,131,522

[45] **Date of Patent: *Oct. 17, 2000**

[54] UNIVERSAL SPACE SAVING FLATBED SCANNER STAND

[75] Inventor: Martha A. Chavez, Greeley, Colo.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/182,848

[22] Filed: Oct. 29, 1998

[51] Int. Cl.[7] ..... A47B 13/08

[52] U.S. Cl. ..... 108/90; 108/43; 108/50.01; 248/918

[58] Field of Search ..... 109/43, 166, 90; 248/918, 346.5, 346.03; 108/50.02, 50.01, 92

[56] References Cited

U.S. PATENT DOCUMENTS

| | | | |
|---|---|---|---|
| 297,219 | 4/1884 | Anthony | 108/166 X |
| 3,791,314 | 2/1974 | Berretta | 108/43 |
| 4,511,111 | 4/1985 | Godfrey et al. . | |
| 4,819,568 | 4/1989 | Coffrin | 108/43 |
| 4,893,775 | 1/1990 | Long | 248/918 X |
| 5,040,760 | 8/1991 | Singer . | |
| 5,158,257 | 10/1992 | Wilson . | |
| 5,311,826 | 5/1994 | Baggiani | 108/166 |
| 5,358,208 | 10/1994 | Moseley, III et al. | 248/918 X |
| 5,503,361 | 4/1996 | Kan-O et al. | 248/918 X |
| 5,623,869 | 4/1997 | Moss et al. | 108/43 |
| 5,715,761 | 2/1998 | Frattini | 108/50.02 |
| 5,725,189 | 3/1998 | Landy | 248/346.03 X |
| 5,859,762 | 1/1999 | Clark et al. | 248/918 X |

FOREIGN PATENT DOCUMENTS

| | | | |
|---|---|---|---|
| 8103269 | 11/1981 | WIPO | 108/166 |

*Primary Examiner*—Jose V. Chen
*Attorney, Agent, or Firm*—Cynthia S. Mitchell

[57] ABSTRACT

A universal space saving flatbed scanner stand that has a scanner platform section and a counterweight platform section which are connected by a hinge that permits the two sections to be at approximately 180 degree angle or 90 degree angle with respect to each other. The flatbed scanner stand permits a desktop to be extended to allow space for a flatbed scanner. The flatbed scanner may be used when the flatbed scanner stand is in the fully extended (180 degree) position. Some scanners may be used when the flatbed scanner stand is in the folded-up (90 degree) position. Alternatively, when the flatbed scanner is not being used, the flatbed scanner stand may be in the folded-up (90 degree) position, in which the flatbed scanner takes-up the space of a sheetfeed scanner. A CPU box, monitor, printer or other sufficiently heavy object may be positioned on the counterweight platform in order to counter the weight of the flatbed scanner on the scanner platform section of the scanner stand. The scanner stand may also include a cabling hole for the scanner power cable and other cables to be threaded through.

10 Claims, 6 Drawing Sheets

UNIVERSAL SPACE SAVING FLATBED SCANNER STAND

FIELD OF THE INVENTION

The present invention relates generally to the field of peripheral devices and more particularly to flatbed scanners. In particular, this invention provides a universal flatbed scanner stand that saves work space.

BACKGROUND OF THE INVENT ION

As the use of personal computers proliferates in everyday business and personal life and as the use of peripheral devices becomes more and more standard at each individual desktop, the space on the individual desktop has become extremely crowded. Computer manufacturers have used different approaches to address the problem of a crowded desktop. These approaches have included various stacking schemes, such as stacking the monitor or printer on top of the computer chassis, combining the mouse and the keyboard as an integral unit, or making the computer or peripherals narrower and taller, such as the computer tower.

Manufacturers of flatbed scanners have made minimal strides in reducing the footprint of the flatbed scanners, and overall, flatbed scanners still take up too much space on the desktop. Some scanner users have moved to sheetfeed scanners, which take up significantly less desktop space than the flatbed scanners. However, sheetfeed scanners do not have the scanning capabilities of a flatbed scanner, such as scanning bound documents, scanning fragile documents and photographs, scanning objects thicker than a sheet of paper, scanning odd shaped objects, etc. A flatbed scanner offers these and other scanning capabilities over the sheetfeed scanner, but takes up a great deal of precious space on the desktop. This leaves scanner users with the choice of trading desktop space for scanner functionality. It would be desirable to have a scanner with the flexibility and functionality of a flatbed scanner that only takes up the desktop area of a sheetfeed scanner.

SUMMARY OF THE INVENTION

The above and other aspects of the present invention are accomplished in a universal space saving flatbed scanner stand with one end that may be placed under the CPU box, the monitor, the printer, any combination of these or any other sufficiently heavy object to act as a counterbalance to a flatbed scanner. The other end of the universal space saving flatbed scanner stand has an opening for the scanner cabling and is hinged in such a manner such that when the scanner stand is extended, it can not extend beyond 180 degrees. The universal space saving flatbed scanner stand may be placed on the left or right side of the desktop and extends the useful desk space out by the width of a flatbed scanner when the scanner is in use and folds up to the size of a sheetfeed scanner when the scanner is not in use.

BRIEF DESCRIPTION OF THE DRAWINGS

The above and other objects, features and advantages of the present invention will be better understood by reading the following more particular description of the invention, presented in conjunction with the following drawings, wherein.

DETAILED DESCRIPTION OF THE PREFERRED EMBODIMENT

Figure 1:
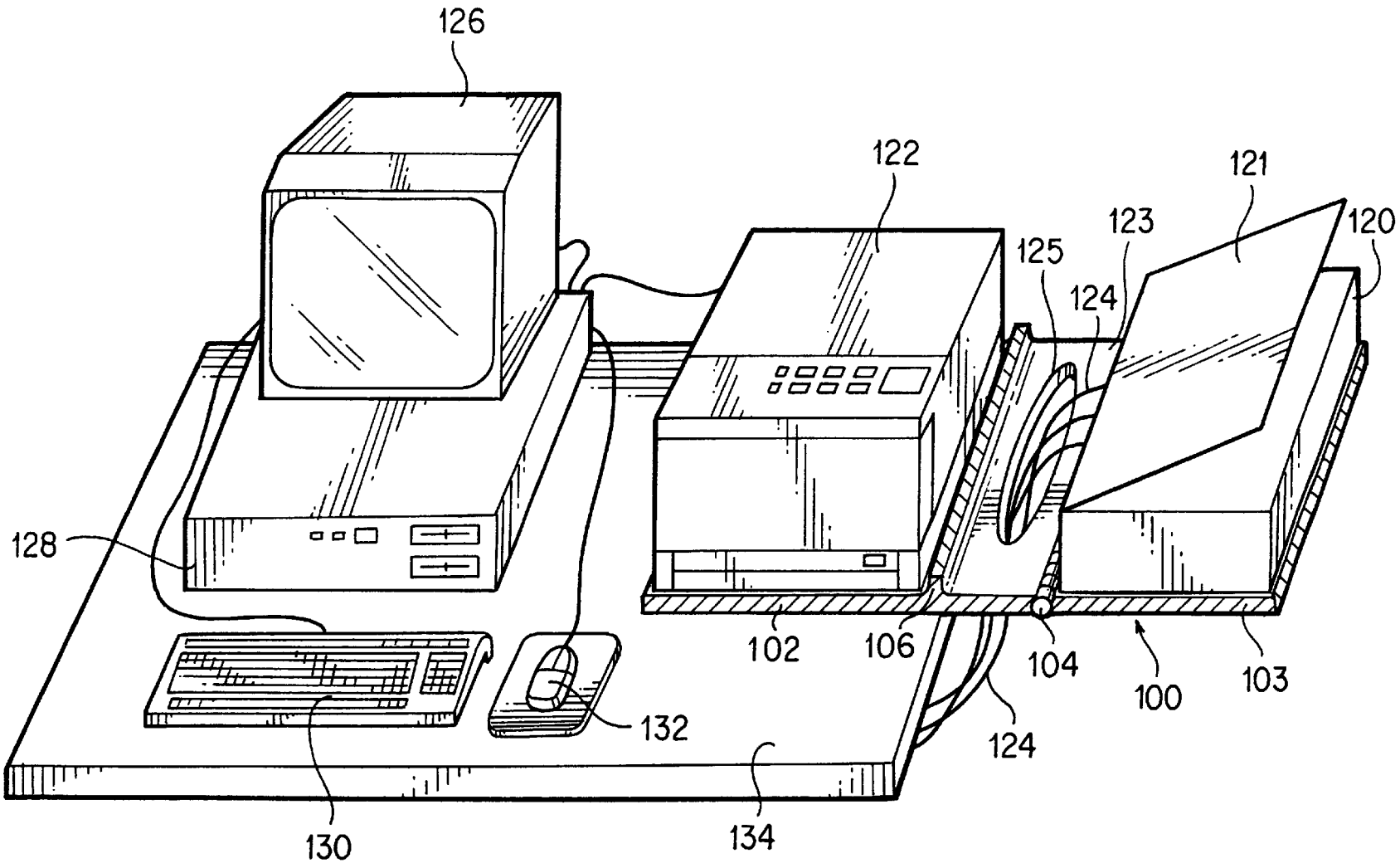
FIG. 1 shows a front perspective view of the universal space saving scanner stand in the fully extended position on the right side of the desktop with a printer as the counterweight according to the present invention.
Figure 2:
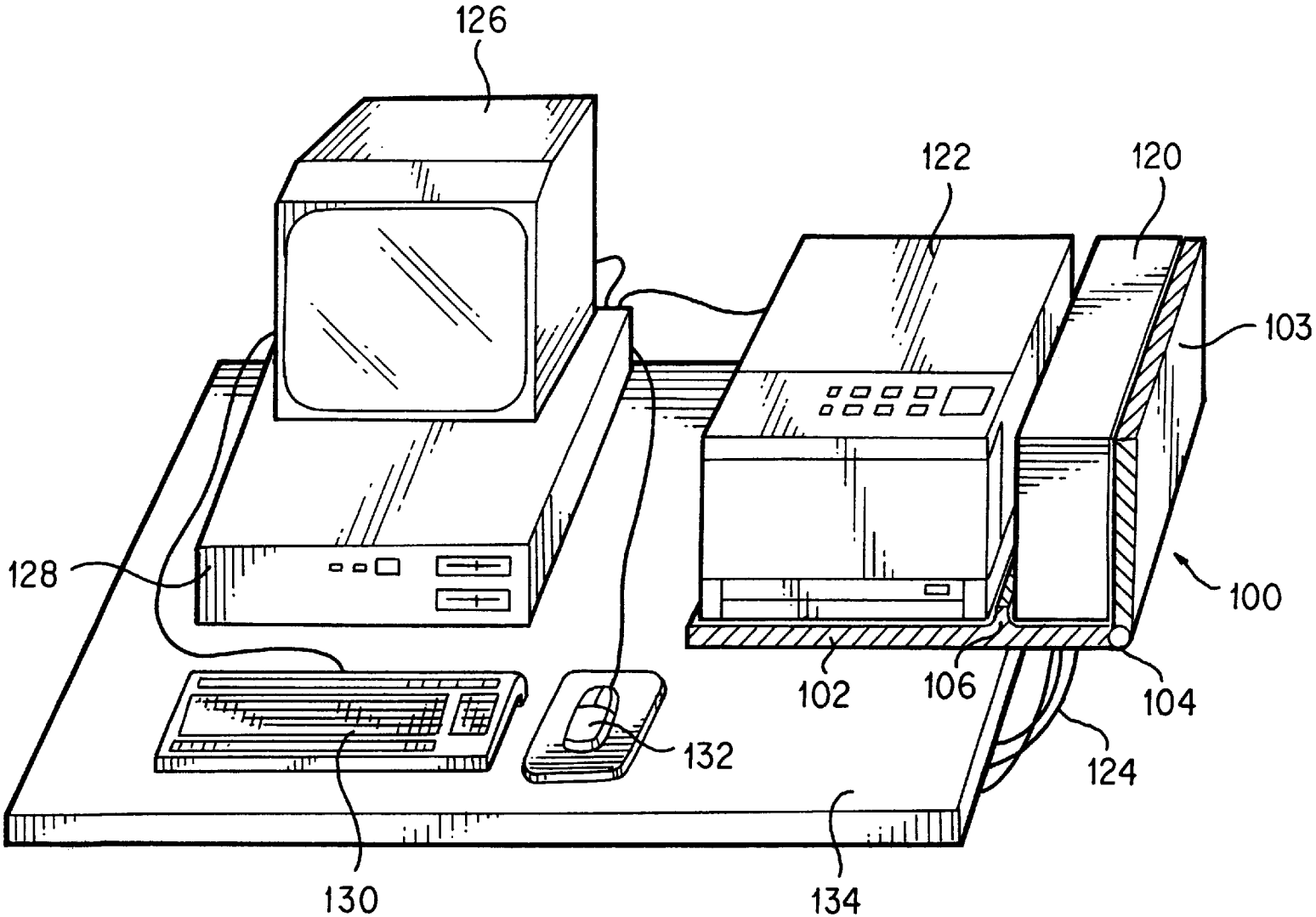
FIG. 2 shows a front perspective view of the universal space saving scanner stand in the folded up position on the right side of the desktop with a printer as the counterweight according to the present invention.

FIGS. 1 and 2 show some of the components of a typical personal computer user's desktop 134 today, that is a CPU box 128, a monitor 126, a keyboard 130, a mouse 132 a printer 122 and a scanner 120. FIGS. 1 and 2 illustrate the universal space saving flatbed scanner stand 100 being used on the right hand side of the desktop 134 with a printer 122 as the counterweight on the counterweight platform section 102 of the scanner stand 100. In FIG. 1, the universal space saving flatbed scanner stand 100 is in the fully extended position with the scanner 120 on the scanner platform section 103 of the scanner stand 100 and the power and computer connection cables 124 of the scanner 120 threaded through the cabling hole 125 of cabling section 123 of the scanner stand 100. The scanner platform section 103 is connected to the counterweight platform section 102 by a hinge 104 that enables the two sections of the scanner stand 100 to be at either 180 degrees or 90 degrees with respect to each other. FIG. 1 shows the scanner platform 103 at approximately a 180 degrees to the counterweight platform 102 with the scanner lid 121 capable of being opened and the scanner 120 capable of being used.

FIG. 2 illustrates the universal space saving flatbed scanner stand 100 being used on the right hand side of the desktop 134 with a printer 122 as the counterweight on the counterweight platform section 102. The flatbed scanner 120 and the flatbed scanner platform section 103 are in the folded-up position at approximately a 90° angle to the counterweight platform section 102. It will be appreciated in FIG. 2 that when the scanner platform 103 is in the folded-up position, some scanners 120 may not be useable and some scanner lids may not be secure or not be able to be opened. Also, when the scanner platform 103 is in the folded-up position, the scanner 120 takes up approximately the same amount of space as a sheetfeed scanner.

Figure 3:
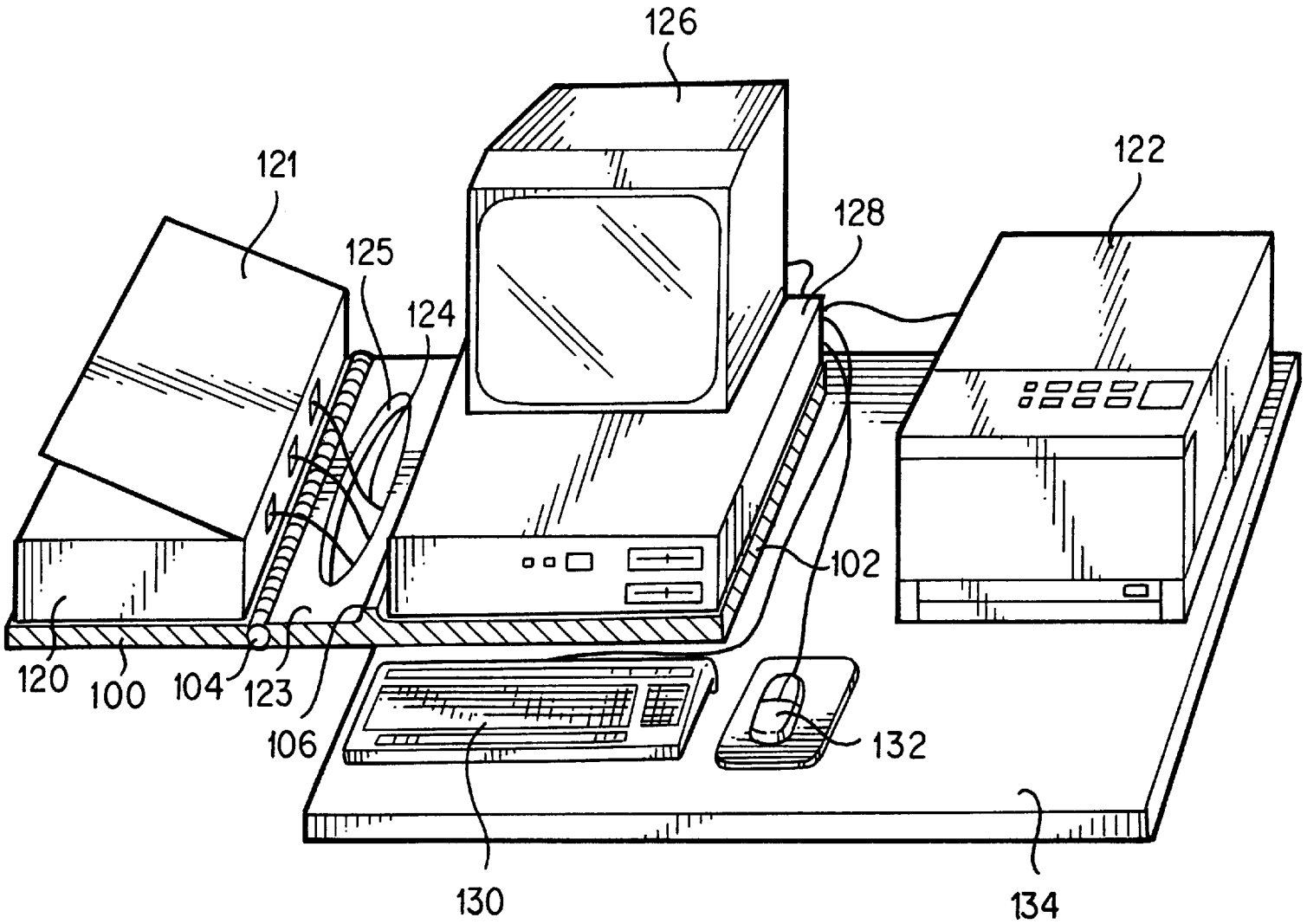
FIG. 3 shows a front perspective view of the universal space saving scanner stand in the fully extended position on the left side of the desktop with a CPU box and monitor as the counterweight according to the present invention.
Figure 4:
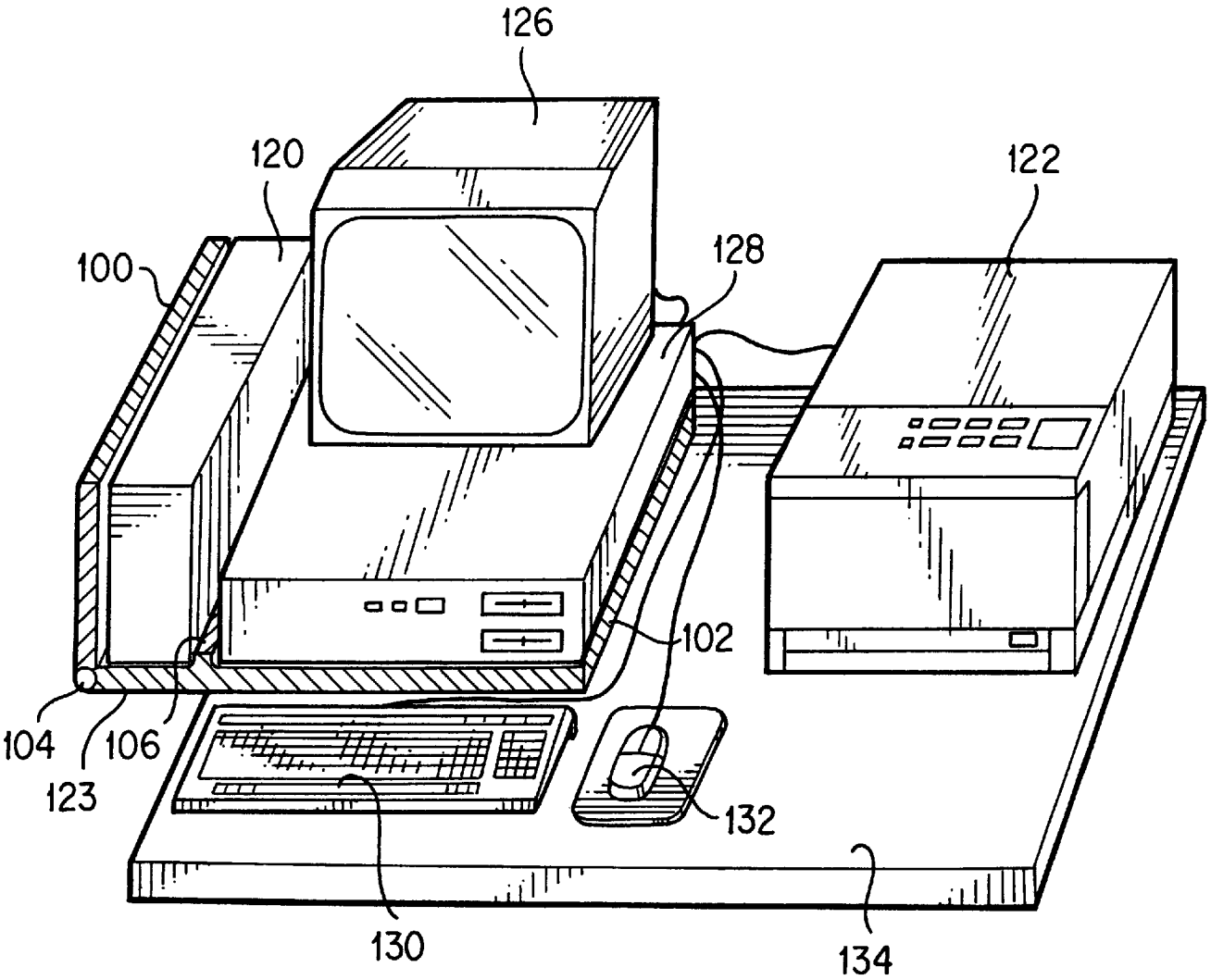
FIG. 4 shows a front perspective view of the universal space saving scanner stand in the folded up position on the left side of the desktop with a CPU box and monitor as the counterweight according to the present invention.

FIGS. 3 and 4 illustrate the universal space saving flatbed scanner stand 100 being used on the left hand side of the desktop 134 with a CPU box 128 and a monitor 126 as the counterweight on the counterweight platform section 102 of the scanner stand 100. In FIG. 3, the universal space saving flatbed scanner stand 100 is in the fully extended position with the scanner 120 on the scanner platform section 103 of the scanner stand 100 and the power and computer connection cables 124 of the scanner 120 threaded through the cabling hole 125 of cabling section 123 of the scanner stand 100. The scanner platform section 103 is connected to the counterweight platform section 102 by a hinge 104 that enables the two sections of the scanner stand 100 to be at either a 180 degree angle or a 90 degree angle with respect to each other. FIG. 3 shows the scanner platform 103 at approximately a 180 degree angle to the counterweight platform 102 with the scanner lid 121 capable of being opened and the scanner 120 in a position that enables it to be used.

FIG. 4 illustrates the universal space saving flatbed scanner stand 100 being used on the left hand side of the desktop 134 with a CPU box 128 and a monitor 126 as the counterweight on the counterweight platform section 102. The flatbed scanner 120 and the flatbed scanner platform section 103 are in the folded-up position at approximately a 90 degree angle to the counterweight platform section 102. It will be appreciated in FIG. 4 that when the scanner platform 103 is in the folded-up position, some scanners 120 may not be able to be used and some scanner lids 121 may not be able to be opened or may not be secure. Also, when the scanner platform 103 is in the folded-up position, the scanner 120 takes up approximately the same amount of space as a sheetfeed scanner.

Figure 5:
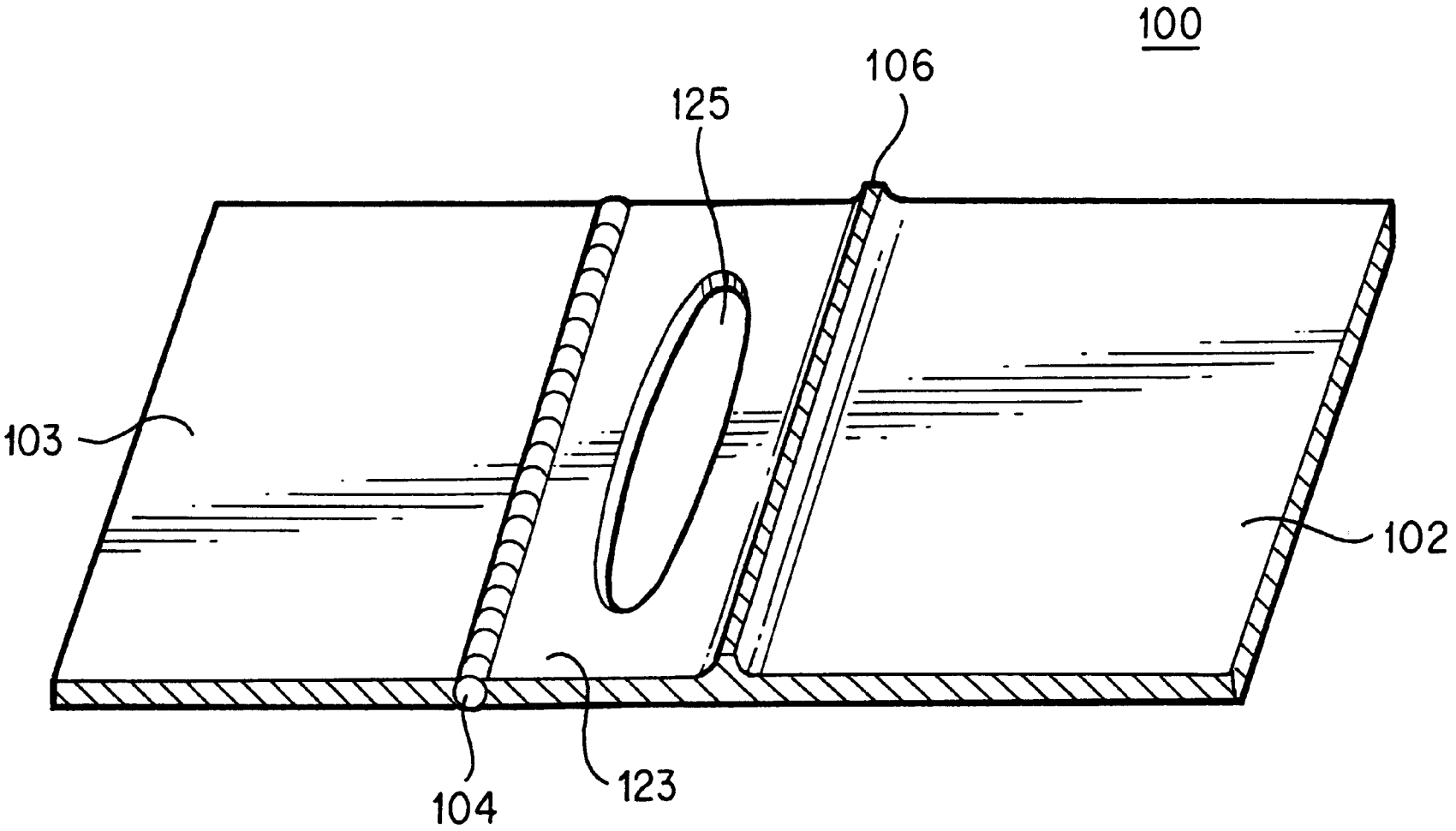
FIG. 5 shows a front perspective view of the universal space saving scanner stand alone in the fully extended position according to the first embodiment of the present invention.

FIG. 5 illustrates the universal space saving flatbed scanner stand 100 with counterweight platform section 102, cabling section 123 with cabling hole 125, hinge 104, and scanner platform section 103. The scanner stand may also include a ridge 106 on the counterweight platform 102 for the counterweight object to abut against. There may also be a ridge (not shown) on the scanner platform 103 for the scanner 120 to abut against. The universal space saving flatbed scanner stand 100 may be made of any sufficiently strong material to support the weight of a flatbed scanner 120, such as wood, metal, or strong plastic. For cost purposes, the scanner stand 100 may preferably be made of a strong plastic material. The hinge 104 should be strong enough to support the weight of a flatbed scanner 120 when the scanner platform 103 is in the fully extended position. The hinge should also move between the fully extended (180 degree) position and the folded-up (90 degree) position and may click into either or both of these positions.

Figure 6:
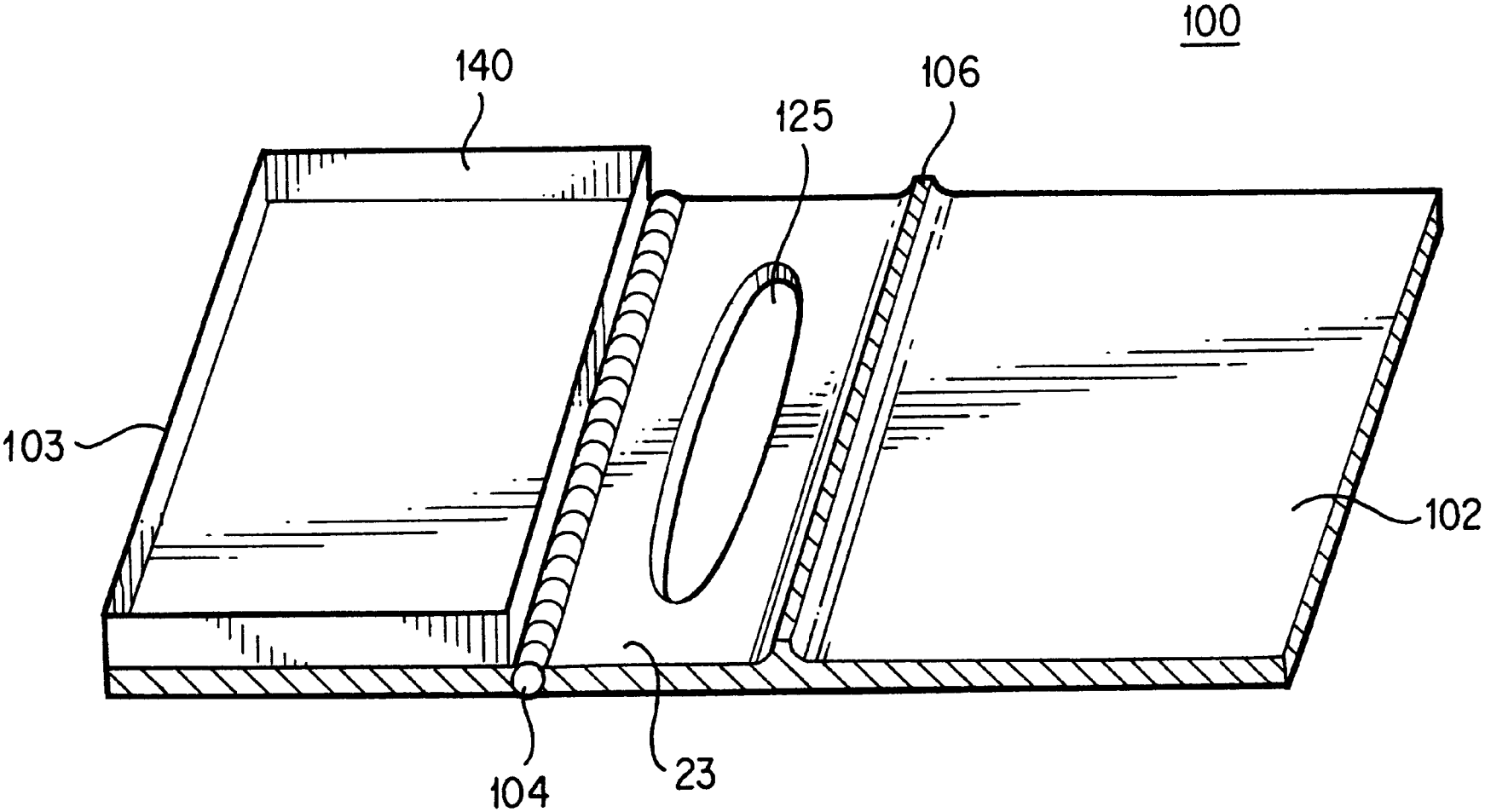
FIG. 6 shows a front perspective view of the universal space saving scanner stand alone in the fully extended position according to a second embodiment of the present invention.

It may be desirable to have a means for securing or attaching a scanner 120 to the scanner platform section 103 of the scanner stand 100 so that the scanner 120 does not slip off of the scanner stand 100. This may be accomplished in several different ways, such as Velcro on the bottom of the scanner 120 and on the scanner platform 103, Velcro straps attaching the scanner 120 to the scanner platform 103, screws, adhesive, snaps, clamps, etc. FIG. 6 illustrates one possibility, which is to have a ledge 140 that runs around the perimeter of the scanner platform 103 to secure the scanner 120 against sliding off of the scanner platform 103.

The foregoing description of the present invention has been presented for purposes of illustration and description. It is not intended to be exhaustive or to limit the invention to the precise form disclosed, and other modifications and variations may be possible in light of the above teachings. For example, the scanner stand 100 may be made out of a different material than those disclosed herein, so long as the material is sufficiently strong to support the weight of a flatbed scanner. Also, the counterweight object may be any sufficiently heavy object that will counter the weight of a flatbed scanner. Also, no counterweight may be used and the scanner stand 100 may be attached to the desktop or side of the desk, although this would limit the versatility of the scanner stand 100. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A universal space saving flatbed scanner stand, comprising:

a counterweight panel;

a scanner panel pivotally mounted to said counterweight panel so that said scanner panel may be rotated with respect to said counterweight panel between an upright position and an extended position, said scanner panel being sized to receive a flatbed scanner apparatus so that the flatbed scanner apparatus is in a stowed position when said scanner panel is in the upright position and so that the flatbed scanner apparatus in an operating position when said scanner panel is in the extended position; and a cabling panel mounted between said counterweight panel and said scanner panel so that said cabling panel is fixed with respect to said counterweight panel and so that said scanner panel is pivotally mounted to said cabling panel, said cable panel providing a horizontal spacing between said counterweight panel and said scanner panel.

2. The flatbed scanner stand of claim 1, wherein said cabling panel comprises an integral portion of said counterweight panel.

3. The flatbed scanner stand of claim 1, wherein said cabling panel includes a cabling aperture therein for receiving a cable from the flatbed scanner.

4. The flatbed scanner stand of claim 1, further comprising a transverse ridge located at about a juncture between said counterweight panel and said cabling panel.

5. The flatbed scanner stand of claim 1, further comprising a ledge located at about a perimeter region of said scanner panel, said ledge retaining the flatbed scanner within said scanner panel.

6. The flatbed scanner stand of claim 1, further comprising a mounting system for securing the flatbed scanner to said scanner panel.

7. The flatbed scanner stand of claim 6, wherein said mounting system comprises a fabric hook and loop fastening system.

8. The flatbed scanner stand of claim 7, wherein said mounting system comprises an adhesive positioned between said scanner panel and the flatbed scanner.

9. The flatbed scanner stand of claim 1, wherein said scanner panel is substantially perpendicular to said counterweight panel when said scanner panel is located in the upright position.

10. The flatbed scanner stand of claim 1, wherein said scanner panel is substantially aligned with said counterweight panel when said scanner panel is located in the extended position.

* * * * *